5/15/84 XR 4,449,041

United States Patent [19]

Girard

[11] 4,449,041

[45] May 15, 1984

[54] METHOD OF CONTROLLING ANTIAIRCRAFT FIRE

[75] Inventor: Donald D. Girard, Concord, Mass.

[73] Assignee: Raytheon Company, Lexington, Mass.

[21] Appl. No.: 457,831

[22] Filed: Jan. 14, 1983

Related U.S. Application Data

[63] Continuation-in-part of Ser. No. 193,867, Oct. 3, 1980, abandoned, which is a continuation-in-part of Ser. No. 967,539, Dec. 7, 1978, abandoned.

[51] Int. Cl.[3] ..... G06F 15/58; F41G 3/04

[52] U.S. Cl. ..... 235/412; 235/411; 364/423

[58] Field of Search ..... 235/404, 411, 412; 364/423

[56] References Cited

U.S. PATENT DOCUMENTS

| | | | |
|---|---|---|---|
| 3,798,420 | 3/1974 | Kaaz | 235/411 X |
| 4,004,729 | 1/1977 | Rawicz et al. | 235/404 |
| 4,020,324 | 4/1977 | Buscher et al. | 235/411 X |
| 4,037,202 | 7/1977 | Terzian | 364/423 X |
| 4,124,849 | 11/1978 | Zahornasky et al. | 235/411 X |
| 4,128,837 | 12/1978 | Page | 235/412 X |
| 4,218,834 | 8/1980 | Robertson | 235/412 |

*Primary Examiner*—Felix D. Gruber

*Attorney, Agent, or Firm*—Philip J. McFarland; Joseph D. Pannone

[57] ABSTRACT

A method of controlling antiaircraft fire is described in which an aircraft is tracked continuously during the flight of a burst of projectiles and the probability of a hit is continuously revised according to the latest target maneuver as the projectiles proceed to the intercept point. If, before all of the projectiles reach the aircraft, the probability of a hit falls below a specified level, another burst of projectiles is fired. As this second burst proceeds to target its computed probability of hit is combined with that of the previously fired burst to determine the cumulative probability of hit of the two bursts taken together. If, before the second burst reaches the target, the cumulative probability falls below the specified level then a third burst is fired. This activity repeats until the cumulative probability of hit is driven up and kept up above the specified level.

1 Claim, 2 Drawing Figures

METHOD OF CONTROLLING ANTIAIRCRAFT FIRE

CROSS-REFERENCE TO RELATED APPLICATION

This is a continuation-in-part of application Ser. No. 193,867 filed Oct. 3, 1980 which is a continuation-in-part of application Ser. No. 967,539 filed Dec. 7, 1978 both now abandoned.

BACKGROUND OF THE INVENTION

This invention pertains generally to antiaircraft fire control methods and particularly to methods of such type wherein projectiles are shot from artillery pieces at a high rate of fire.

Many types of antiaircraft weapon systems utilize automatic guns which are capable of such a high rate of fire that the barrels of such guns cannot long withstand the cumulative effects of heating during continuous fire. To reduce heating effects to tolerable levels, it is, therefore, standard operating procedure to fire automatic guns in bursts so that advantage may be taken of the high rates of fire possible with such guns without overheating the gun barrels.

When the rate of fire in a burst is high enough, the individual rounds may be considered to correspond with fragments of an explosive shell detonated at an aiming point at a given range. That is to say, if the individual rounds in a burst follow one another with such rapidity that no significant movement of an aircraft may occur during the burst, the individual rounds in a burst from an automatic gun may be considered to be randomly distributed about a centroid in the same way as fragments of an explosive shell are. Similarly, if a plurality of bursts, i.e. a "string" of bursts, is fired toward closely grouped aiming points, the centroid of the centroids of the individual strings may be considered to correspond with the centroid of the fragments of an explosive shell.

SUMMARY OF THE INVENTION

With the foregoing in mind, it is a primary object of this invention to provide a method of fire control of antiaircraft artillery whereby relatively short bursts, each containing shells fired at a relatively high rate of fire, of explosive shells may be fired at a maneuvering airborne target with a high degree of confidence that damage will result.

Another object of this invention is to provide a fire control doctrine whereby a burst of shells is fired only when it becomes manifest that a previously fired burst will be ineffective. The underlying object here is to minimize consumption of ammunition and the erosion of the gun tube.

Another object of this invention is to provide a method of fire control whereby a predetermined level of hit probability is achieved in the shortest possible time without undue expenditure of ammunition. It is important that the desired kill probability be attained early in the engagement since time is of the essence in interdicting the target from the completion of its mission.

The foregoing and other objects of this invention are attained generally by tracking an airborne target as a burst of explosive shells is in flight toward a predicted point of interception, and, based on the latest extrapolations of the target trajectory, recomputing the probability of hitting the airborne target by the burst and, if the calculation indicates that such probability when combined with that of all previous bursts is less than a specified level, firing another burst toward a newly calculated point of interception.

BRIEF DESCRIPTION OF THE DRAWINGS

For a more complete understanding of this invention, reference is now made to the following description of a preferred embodiment of the invention as illustrated in the accompanying drawings wherein.

DESCRIPTION OF THE PREFERRED EMBODIMENT

Figure 1:
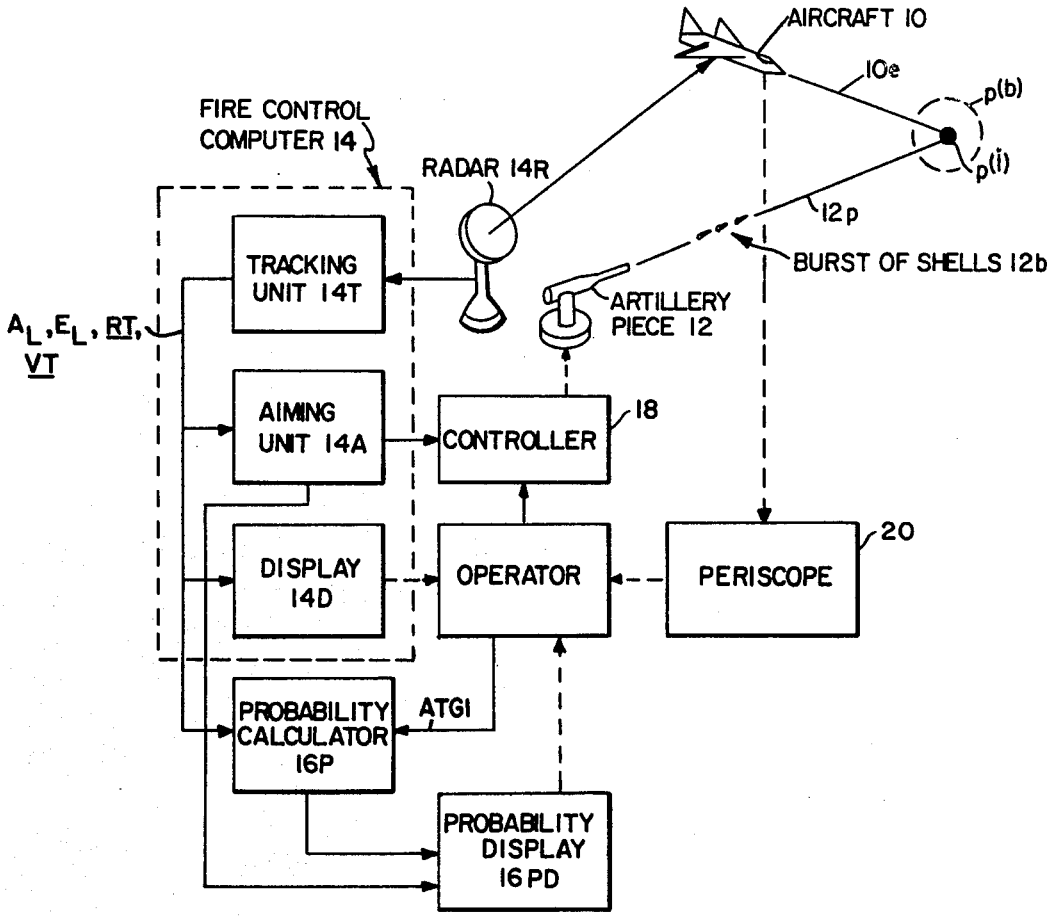
FIG. 1 is a generalized sketch of a fire control system using the contemplated method.

Referring now to FIG. 1, an exemplary tactical situation in which the contemplated method is intended to be followed is shown. Thus, an airborne target, here an aircraft 10, is shown to be within range of a conventional artillery piece 12 which in turn is aimed and fired under command of a conventional fire control computer including radar 14R, a probability calculator 16P, and a controller 18. The fire control computer 14 is shown generally to include a tracking unit 14T, an aiming unit 14A and a display 14D. If the aircraft 10 were to continue along its established course (as shown by the line labeled "10*e*") without taking any evasive action, the centroid of a burst of shells 12*b* following a trajectory labeled 12*p* would correspond substantially with the predicted position (labeled p(i)) of the aircraft 10. That is to say, the aircraft 10 would, considering the dispersion of the individual projectiles in the burst, then be within the lethal zone of the burst (shown by the line p(b)).

The fire control here may be an AVADS Fire Control Radar used in the VULCAN Air Defense System manufactured by General Electric Company, Lakeside Avenue, Burlington, Vt. 05421. The probability calculator 16P may be a conventional microprocessor and may, for example, comprise a 2900 series microprocessor from Advanced Microdevices, Inc., Sunnyvale, Calif. 94086. In operation, data from the radar 14R (range, bearing and elevation of the aircraft 10) are fed into the tracking unit 14T of conventional construction to allow the position, velocity and course of the aircraft 10 to be calculated. The output of the tracking unit 14T is, in turn, fed into an aiming unit 14A, a display 14D and to the probability calculator 16P. The aiming unit 14A is, of course, responsive to signals out of the tracking unit 14T to produce azimuth and elevation angle command signals for aiming the artillery piece 12 at the predicted position p(i) of the aircraft 10 to cause a burst to intercept such target. The controller 18 is also conventional, being responsive to the azimuth and elevation angle command signals actually to aim the artillery piece 12. Firing command signals for the latter here are generated when an operator (not numbered), using either the display 14D or a periscope 20, decides to actuate a conventional firing mechanism (not shown). A signal indicative of firing is also supplied to the probability calculator 16P. The probability calculator 16P here is contemplated to provide a signal indicative of the cumulative probability, $P_K$, of destroying the target, taking into account all the rounds that have been fired at it since the beginning of the engagement. The probability calculator continually updates $P_K$ in order to reflect any lessening of the probability resulting from a maneuver of the aircraft 10. The method for calculating the cumulative probability, $P_K$, of destroying the target will be explained in detail hereinbelow with reference to FIG. 3. Suffice it to say here that the probability calculator 16P accepts as input signals the vector range, RT, and velocity, VT, of the target from the fire control computer 14 and, from the gun controller a logical signal NRL which assumes the value "TRUE" each time a new shell has been fired, $t_L$, the launch azimuth angle, $A_L$, and the launch elevation angle, $E_L$. It takes an input $A_{TGI}$ set in by the operator. $A_{TGI}$ is the vulnerable area of the target, a parameter used in computing probability of survival given a value for miss distance. The probability calculator outputs $P_K$ the cumulative probability of kill to the display unit and it resets the logical NRL to false each time through the main path of the compute loop.

Figure 2:
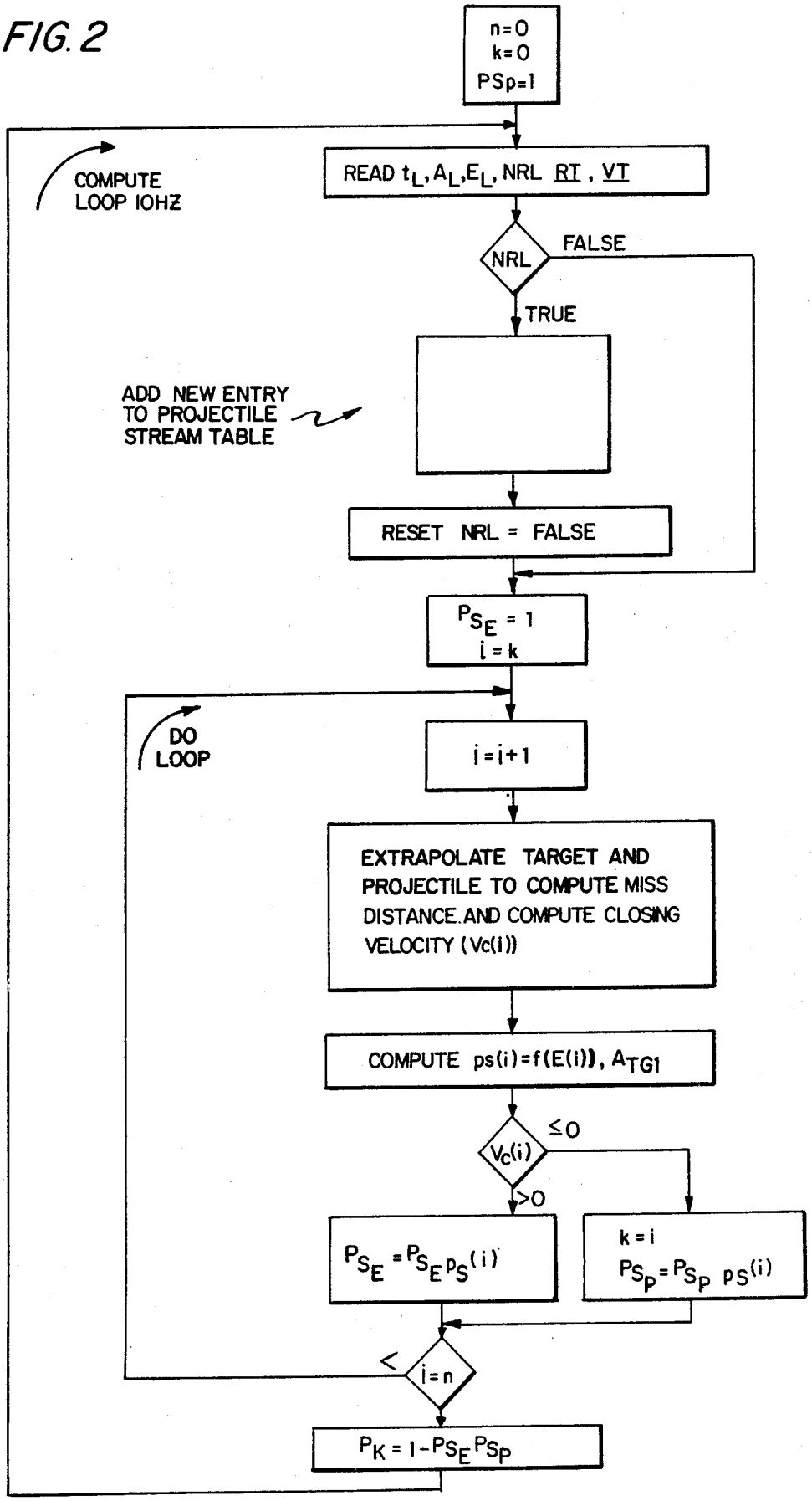
FIG. 2 is a flow diagram showing the way in which probability is calculated.

The detailed process is explained now using FIG. 2. The explanation proceeds on the basis of a single gun whose rapid fire rate is 10 rounds per second or less. The extension to multiple guns, possibly firing asynchronously and at higher rates, is straightforward to one skilled in the field.

At the beginning of the engagement, n, the number of rounds that have been fired at the target under attack, is initialized to zero; k, the number of rounds that have gone past target range is initialized to zero; and $P_SP$, the cumulative probability that the target has survived the rounds that have gone past it is set to unity (the reason for which is obvious since k is initially zero by definition).

The compute loop cycles at 10 HZ rate, updating the computation of $P_K$, the cumulative probability of kill each time. The update rate of this loop must be at least as great as the firing rate capability of the gun in order not to fail to account for a round that may have been launched.

The first event in the compute loop is to read all the input variables mentioned earlier. Then it asks whether a new round has been fired by examining the state of the logical variable NRL. If NRL=TRUE, signifying that a new round has been launched, the process passes down to the block labeled "Add New Entry to the Projectile Stream Table". This is a table that remembers the time, azimuth and elevation of launch of each round by index number. Afterwards NRL is reset to false preparatory for the firing of the next round. It will be noted that the probability calculator and the gun controller both control the state of the logical variable NRL. However, the gun controller can only set it TRUE and the probability calculator can only set it FALSE.

Now that the projectile stream table has been updated the compute loop passes down to the computation of $P_K$. The first step is to set $P_{SE}$, the probability that the target will survive the rounds enroute to it to unity. The reason for doing this is because this probability is calculated anew each compute cycle, i.e., all past memory regarding the probabilities associated with the rounds enroute is wiped out and then the values recalculated each time.

The next step is to set i, the index of the "DO" loop, to k which is the number of rounds that have gone past the target and no longer therefore need be updated.

Within the "DO" loop each round is extrapolated to determine a maximum miss distance using the most recent data RT and VT in extrapolating the position of the target. This extrapolation process is virtually identical to that used by the fire control computer in determining the launch angle in the first place. It is a process well known to those skilled in the field of gun control systems and requires the use of ballistic tables. The target is projected ahead using either straight line extrapolation or higher order extrapolation (the former being the preferred method). The result of the joint extrapolation of target and projectile is maximum miss distance, E. Also, the closing velocity of the round with the target is computed, negative meaning that a round has gone past the target.

The next step is to compute $P_s(i)$ the probability that the target will survive the $i^{th}$ round. The probability is dependent on miss distance and target vulnerability area.

Afterwards, the polarity of the closing velocity, $V_c$, is considered. If it is negative than the round in question has gone past the target and must be dropped from the $P_{SE}$ update process. In this case the right branch in the flow diagram is taken ($V_c \leqq 0$) and k is updated to i. Then $P_{SP}$, the cumulative probability of the target surviving all the rounds that have passed it, is updated. If $V_c > 0$, the round in question is still enroute and so $P_{SE}$ is updated.

Afterwards i is compared to n to see if the "DO" loop is to be terminated. When i becomes equal to n all rounds have been accounted for and the program passes down to the final clock which calculates $P_K$.

Having described an embodiment of this invention, it will now be clear to one of skill in the art that the basic concept here is to reduce the time taken to assess whether or not a burst will be effective by determining the probability of at least one bit before the individual rounds in any burst reach a predicted point of impact with an aircraft. It will also be clear that changes may be made without departing from my inventive concepts. For example, instead of using the measured range at firing to calculate the initial probability of a hit, it would be as effective to use the calculated range to the predicted point of impact. It is felt, therefore, that this invention should not be restricted to its disclosed embodiment, but rather should be limited only by the spirit and scope of the appended claims.

What is claimed is:

1. The method of controlling an antiaircraft gun adapted to firing bursts of projectiles at a target aircraft, such method comprising the steps of:

(a) tracking the target aircraft to determine the course and speed of such aircraft;

(b) calculating the azimuth and elevation angles of the antiaircraft gun to provide proper lead angles to cause a first burst of projectiles from the antiaircraft gun to intercept the target aircraft at a calculated range;

(c) determining the initial probability that at least one of the projectiles in the first burst will intercept the target aircraft at the calculated range and firing such burst;

(d) continuing to track the target aircraft and to calculate the azimuth and elevation angles and the range to intercept;

(e) determining the change in probability that at least one of the projectiles in the first burst will intercept the target aircraft; and (f) firing a second burst of projectiles at the target aircraft if the initial probability decremented by the change in probability falls below a predetermined level.

* * * * *